United States Patent [19]

Längle

[11] Patent Number: 4,667,734

[45] Date of Patent: May 26, 1987

[54] HEAT EXCHANGER

[76] Inventor: Karl Längle, Wermatswilerstr. 86, CH-8610 Uster, Switzerland

[21] Appl. No.: 846,837

[22] Filed: Apr. 1, 1986

Related U.S. Application Data

[63] Continuation of Ser. No. 704,910, Feb. 25, 1985, abandoned, which is a continuation of Ser. No. 473,722, Mar. 9, 1983, abandoned.

[30] Foreign Application Priority Data

Mar. 9, 1982 [CH] Switzerland ..... 1465182

[51] Int. Cl.[4] ..... F28F 9/22

[52] U.S. Cl. ..... 165/145; 165/165; 165/903

[58] Field of Search ..... 165/145, 164, 165, 903

[56] References Cited

U.S. PATENT DOCUMENTS

| | | | |
|---|---|---|---|
| 1,067,689 | 7/1913 | Spotts | 165/145 |
| 1,818,144 | 8/1931 | MacLeod | 165/145 X |
| 2,984,456 | 5/1961 | Young | 165/145 |
| 2,995,342 | 8/1961 | Quattriri | 165/145 |
| 4,418,749 | 12/1983 | Vasilieu et al. | 165/145 X |

FOREIGN PATENT DOCUMENTS

| | | | |
|---|---|---|---|
| 19877 | 2/1944 | Finland | 165/165 |

*Primary Examiner*—Albert W. Davis, Jr.
*Assistant Examiner*—Peggy A. Neils
*Attorney, Agent, or Firm*—Eric P. Schellin

[57] ABSTRACT

The heat exchanger designed, for example, for cooling highly viscous, especially intrinsically viscous free-flowing substances is provided with cooling elements (1) consisting of flat tubes which are built into a straight flow-through area (4) for the free-flowing substance to be cooled. In order to make possible a heat exchanger for intrinsically viscous, free-flowing substances which is as compact as possible, yet very effective, the cooling tubes (1) are arranged in spaced, adjacent rows in parallel planes which run obliquely to the direction of flow (X) of the heat exchanger and are at a distance from each other in the direction of flow of the heat exchanger. The cooling elements (2, 3) arranged in two adjacent planes intersect each other, viewed in the direction of flow of the heat exchanger, at an angle of 90°.

5 Claims, 6 Drawing Figures

HEAT EXCHANGER

This application is a continuation of application Ser. No. 704,910, filed Feb. 25, 1985, now abandoned, which is a continuation of Ser. No. 473,722, filed Mar. 9, 1983, now abandoned.

BACKGROUND OF THE INVENTION

1. Field of the Invention

The invention is related to the field of heat exchangers for cooling or heating highly viscous, especially intrinsically viscous, free-flowing substances with rod-shaped or tabular cooling or heating elements built in a straight flow-through area of the free-flowing substance to be cooled or heated.

2. Description of the Prior Art

The special flow behaviour of pasty, highly viscous liquids, especially of intrinsically viscous free-flowing substances, causes problems which can not be solved in customary plate or tube heat exchangers.

The use of single-tube heat exchangers is also known in which an even flow is achieved, but in which enormous pressure losses of up to 80 bar result due to the requisite long tube lengths.

A heat exchanger for highly viscous, especially intrinsically viscous, free-flowing substances is also known in which the flow-through area for the substance to be cooled or heated is subdivided by baffles into several chambers which communicate with each other and a wave-like flow with changes of direction of 180° per change is imposed in this manner on the substance flowing through. Although the conditions of flow in this heat exchanger are considerably better than they are in the other two known constructions, the deflection points with their change of direction of 180° often cause problems when the heat exchanger runs in neutral and when it is cleaned.

The present invention has the task of creating a heat exchanger which is suitable for highly viscous, especially intrinsically viscous, free-flowing substances and which does not have the above-mentioned disadvantages of the previously known heat exchangers, that is, in which the flow goes evenly around all cooling or heating elements, a minimum pressure loss occurs, no problems appear when it runs in neutral and which is very easy to clean.

SUMMARY

The invention solves this task in a heat exchanger of the type initially described as follows: The cooling or heating elements, which are constructed as flat tubes, are arranged in spaced, adjacent rows in parallel planes which run obliquely to the direction of flow of the heat exchanger and are at a distance from each other in the direction of flow of the heat exchanger; the cooling or heating elements arranged in two successive planes intersect each other, viewed in the direction of flow of the heat exchanger; and the frontal distance between two adjacent rows of cooling or heating elements is at the most as great as the smallest center-to-center distance between two adjacent cooling or heating elements of these rows. Viewed in cross section, the cooling or heating elements have a width of 3 to 16 mm and a height of 35 to 100 mm and run at least approximately parallel with their broad sides and approximately vertical with their narrow sides to the direction of flow of the free-flowing substance to be cooled or heated. The distance between two laterally adjacent flat tubes is in the range of 3 to 15.

In such a construction of the heat exchanger the substance which is flowing through and is to be cooled or heated is divided at each subsequent row of cooling or heating elements in a new direction into a plurality of partial currents, so that an optimum heat exchange with the heating or cooling medium is achieved.

It is advantageous if the cooling or heating elements constructed as flat tubes have a width of 5 to 12 mm and a height of 50 to 80 mm, viewed in cross section. It is advantageous thereby if the distance between two laterally adjacent flat tubes is in the range of 7 to 10 mm.

In order to achieve the best-possible division of the current of substance flowing through, it is also advantageous if the cooling or heating elements arranged in two successive planes intersect each other at least approximately at a angle of 90°, viewed in the direction of flow of the heat exchanger.

In order to be able to keep the construction of the heat exchanger as simple as possible, it is also advantageous if the cooling or heating elements of a row of cooling or heating elements are at least approximately parallel to the cooling or heating elements of the second-following row of cooling or heating elements. It is advantageous thereby if the cooling or heating elements of a row of cooling or heating elements are staggered in relation to the at least approximately parallel cooling or heating elements of the second-following row of cooling or heating elements preferably by one-half the lateral center-to-center distance between two adjacent cooling or heating elements of a row of cooling or heating elements, viewed in the direction of flow of the heat exchanger.

In order to obtain a construction of the heat exchanger which is as compact as possible, it is also advantageous if the straight flow-through area for the highly viscous, free-flowing substance to be cooled or heated is formed by a tube section which runs in the longitudinal direction of the heat exchanger, has a rectangular, preferably square or hexagonal cross section and is located inside a cylindrical jacket in such a manner that four or six supply and take-off conduits running in the longitudinal direction of the heat exchanger and separated from each other for supplying and removing the cooling or heating medium to be guided through the individual tubular cooling or heating elements are formed between the individual outer surfaces of the square or hexagonal tube section and the inside of the cylindrical jacket, and the open front sides of these cooling or heating elements empty into two of the supply or removal conduits which are formed in this manner and are located opposite one another.

In order to be able to perform a problem-free cleaning of the heat exchanger, it is advantageous if each four successive rows of cooling or heating elements are collected to a heat exchanger section which can be detachably connected as a unit to adjacent units.

BRIEF DESCRIPTION OF THE DRAWINGS

The invention is explained below by way of example with reference made to the drawings.

DETAILED DESCRIPTION

As can be seen from FIGS. 1 to 4, heating elements 1 of the heat exchanger shown are arranged in adjacent rows distanced from each other by the distance a in parallel planes which runs obliquely to the direction of flow X of the heat exchanger and are distanced from each other in the direction of flow X of the heat exchanger.

Heating elements 1 are constructed as flat tubes for conducting a heating medium and are arranged with their wide sides running parallel and their narrow sides running perpendicular to the direction of flow of the intrinsically viscous, free-flowing substance to be cooled or heated. These flat tubes 1 have height h of 5 to 12 mm and a width b of 50 to 80 mm, viewed in cross section, that is, little depth in the direction of flow, so that heating tubes 1 operate in the range of the so called incipient current flow and thus in the range of a considerably improved heat transfer.

In order to obtain as compact a heat exchanger as possible, yet achieve a passage of the flow into the next adjacent or following row of heating elements which is as homogeneous as possible, the front distance c between each two adjacent rows 2 and 3 of heating elements is less than the center-to-center distance m between two adjacent flat heating element tubes 1 of these rows 2 and 3.

This distance c assures that the free-flowing substance to be heated is thoroughly mixed after each passage through a flat tube row before it enters into the following flat tube row, which avoids the formation of short-circuit currents.

In order to obtain the lowest possible pressure loss of the heat exchanger, distance a between two laterally adjacent flat tubes 1 is in the range of 7 to 10 mm.

Figure 1:
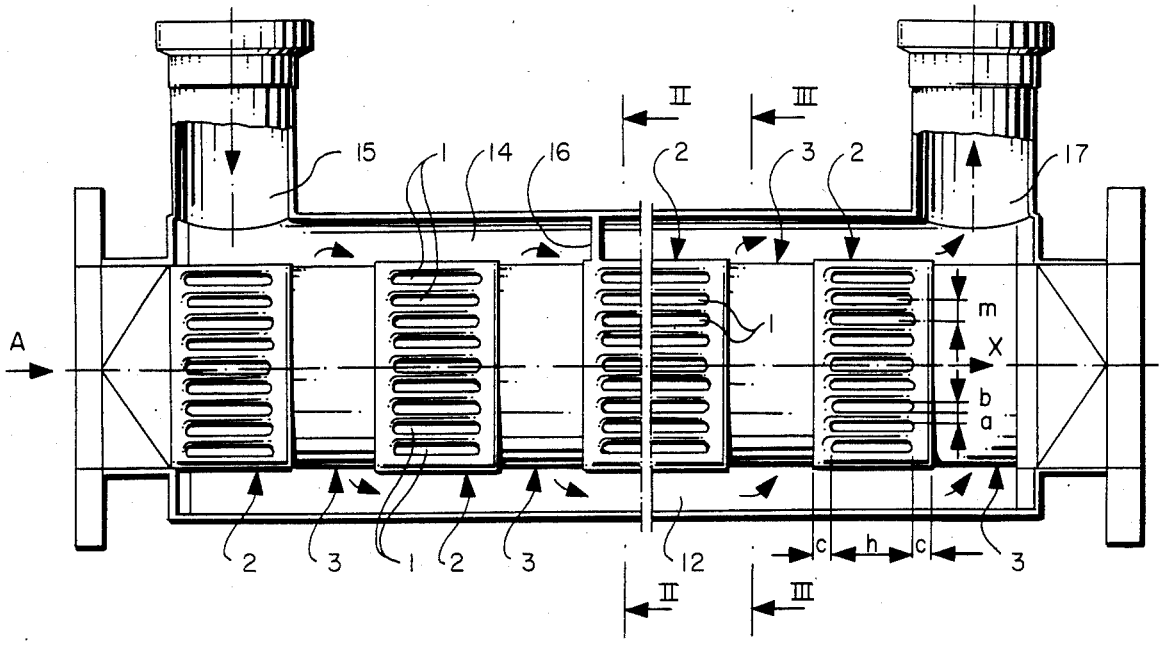
FIG. 1 shows a longitudinal section through a first embodiment of a heat exchanger in accordance with the invention for heating a highly viscous liquid.
Figure 2:
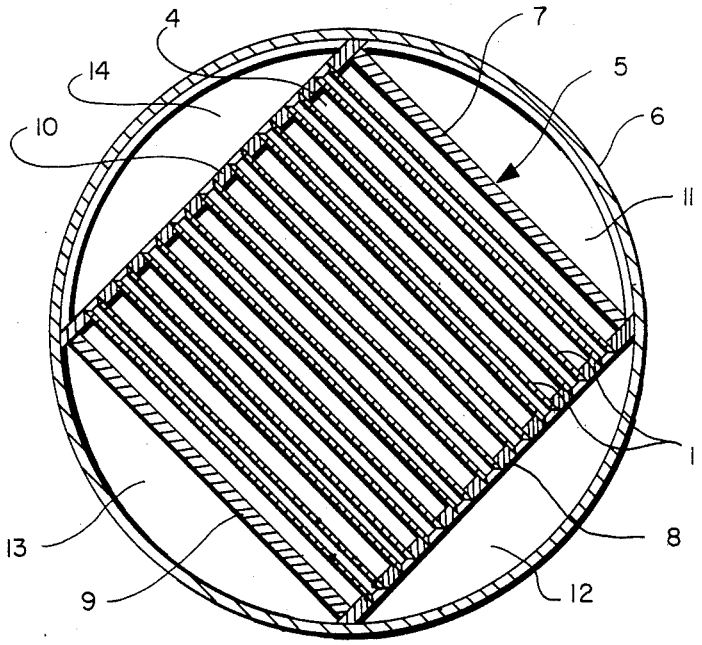
FIG. 2 shows a section along line II—II in FIG. 1.
Figure 3:
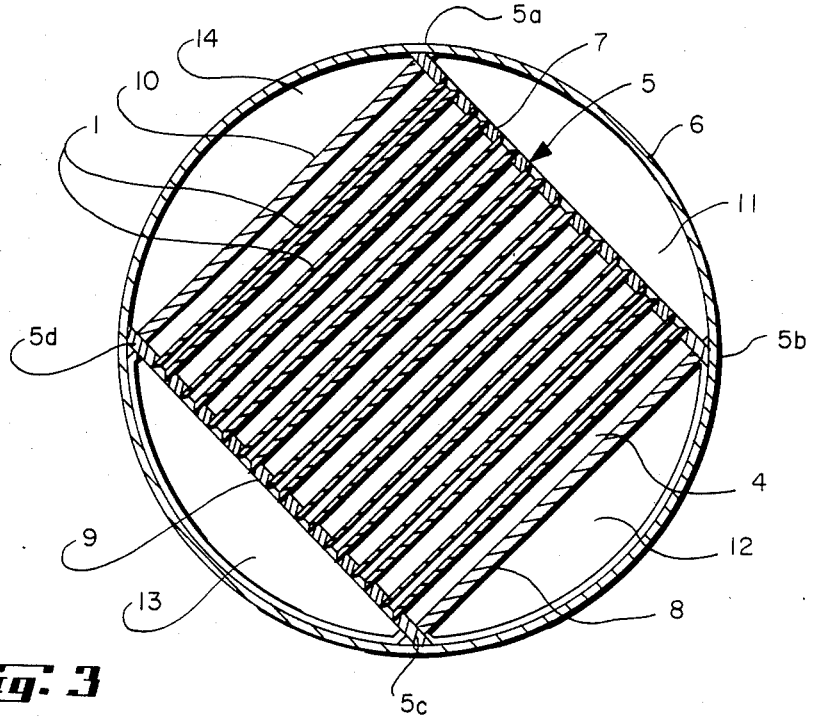
FIG. 3 shows a section along line III—III in FIG. 1.
Figure 4:
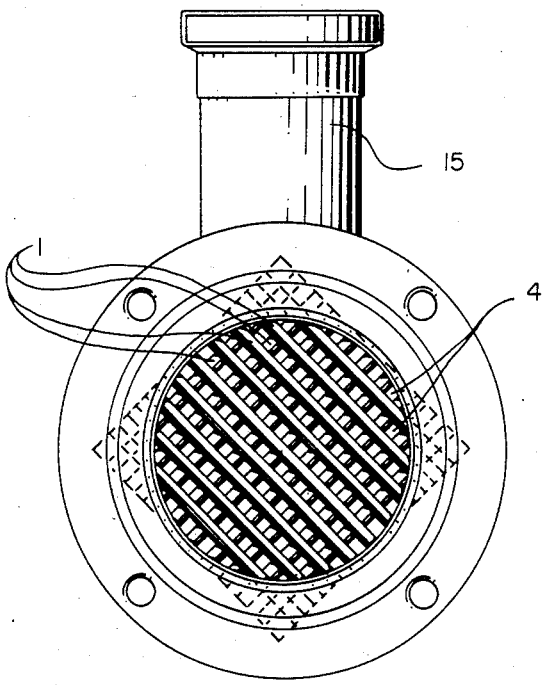
FIG. 4 shows a front view in the direction of arrow A in FIG. 1.

In order to achieve the most complete possible, even distribution of the intrinsically viscous, free-flowing substance flowing through the adjacent rows 2 and 3 of heat exchanger into a plurality of partial currents, heating elements 1, are arranged in two successive planes which intersect each other, viewed in the direction of flow X of the heat exchanger, at an angle of 90°, as is particularly evident in FIG. 4.

In order to make possible the simplest possible compact construction of the heat exchanger, straight flow-through area 4 for the free-flowing substance to be heated is formed by tube section 5, which runs in the longitudinal direction of the heat exchanger and has a square section. Longitudinal edges 5*a*, 5*b*, 5*c* and 5*d* contact the inside of cylindrical jacket 6 and are welded to it in a liquid-tight fashion. This forms four conduits 11, 12,13 and 14 extending in the longitudinal direction of the heat exchanger between the individual outer surfaces 7, 8, 9 and 10 of tube section 5 with a square section and the inside of cylindrical jacket 6. The heating medium is fed via inlet piece 15 into conduits 11 and 14. Blocking disks 16 welded in the conduits 11 and 14 effect a diverting of the heating medium, fed into the conduits, via the flat tube heating elements 1 down into opposite conduits 13 and 12, respectively. From the downstream parts of the conduits 13 and 12 the heating medium flows back via the flat tube heating elements 1 up into the opposite downstream parts of the conduits 11 and 14, respectively, which are separated from their upstream parts by the blocking disks 16. The heating medium then flows from the opposite downstream parts 11 and 14 into the heating medium outlet 17. Blocking disk 16 welded in conduit 14 effects a deflection of the heating medium fed into conduit 14 via flat tubes 1 into the opposite conduit 12 and from it back into the downstream part of conduit 14 and therewith into exit piece 17.

Figure 5:
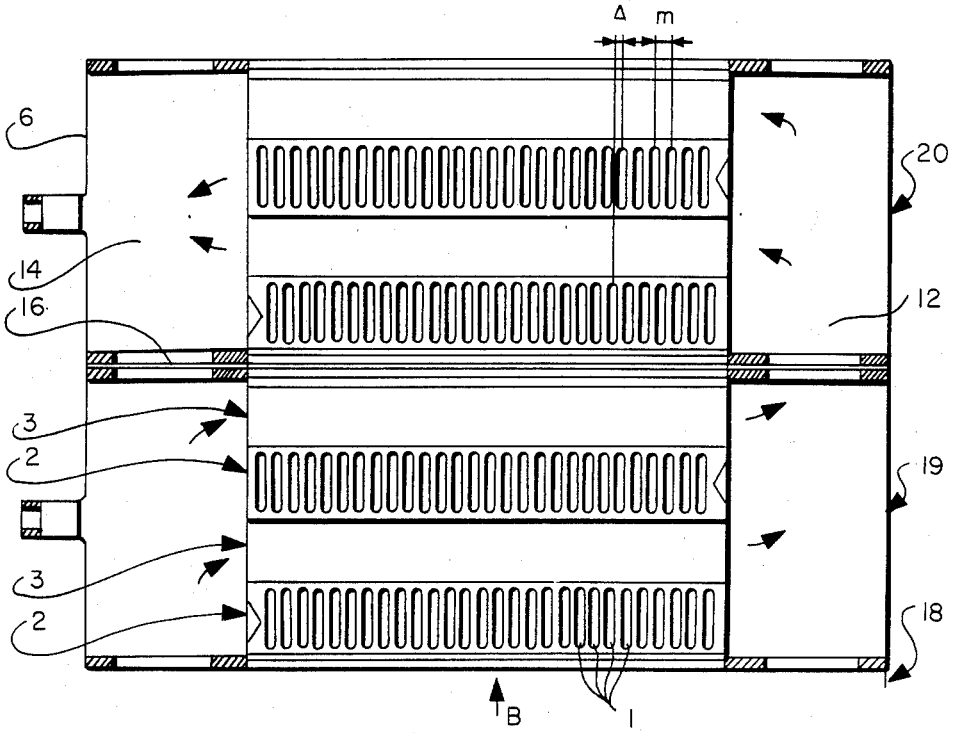
FIG. 5 shows a longitudinal section through a part of a second embodiment of a heat exchanger in accordance with the invention.
Figure 6:
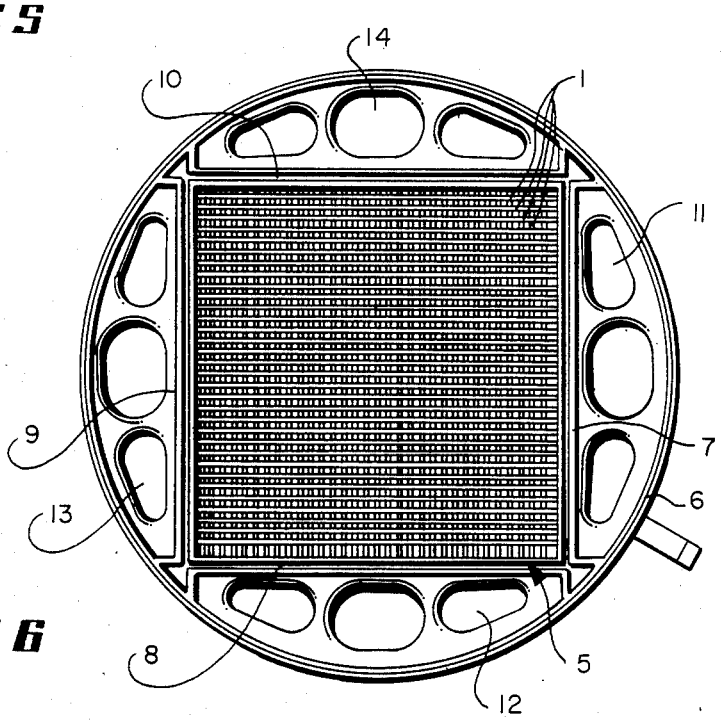
FIG. 6 shows a front view in the direction of arrow B in FIG. 5.

In the embodiment of FIGS. 5 and 6 parts identical to those in the embodiment of FIGS. 1 to 4 are provided with the same reference numerals, so that they do not need to be described again.

In the embodiment of FIGS. 5 and 6 each four successive sections 2, 3, 2', 3' of heating elements rows are collected to a heat exchanger section which can be detachably connected as a unit 18, 19 and 20, respectively, to the adjacent units to form a heat exchanger, so that in order to clean heating elements 1, each two rows of heating elements are readily accessible from a front side of each such section.

In order to achieve an even better division of the intrinsically viscous free-flowing substance flowing through the heat exchanger into several partial currents, flat heating tubes 1 of one row of heating elements are staggered in relation to the parallel flat heating tubes 1'' of the second-following row of heating elements, viewed in the direction of flow of the heat exchanger, by half the lateral distance between two adjacent flat heating tubes of a row of heating elements.

What is claimed:

1. Heat exchanger for cooling or heating pseudoplastic fluids with cooling or heating elements built in a straight flow-through area of the flowable substance to be cooled or heated, characterized in that the cooling or heating elements (1), for conducting the cooling or heating medium in their interior are flat tubes, and are arranged side-by-side and, spaced from each other in rows in parallel planes which run obliquely to the direction of flow of the heat exchanger and are spaced from each other in the direction of flow of heat exchanger, adjacent rows of the flat tubes of the cooling or heating elements (1) arranged in two successive planes intersect each other when viewed in the direction of flow of the heat exchanger, and that the frontal distance (c) abetween two successive rows (2, 3) of cooling or heating elements is at the most as great as the smallest center-to-center distance (m) between two adjacent cooling or heating elements (1) of those rows, whereby the flat tubes of the cooling or heating elements (1) when viewed in cross section, have a height of 5 to 12 mm and width of 50 to 80 mm and run at substantially parallel with their width and substantially perpendicular with their height to the direction of flow of the flowable substance to be cooled or heated; and the distance (a) between two laterally adjacent flat tubes (1) is in the range of 7 to 10 mm, whereby heating or cooling of the pseudoplastic fluids can be accomplished without pulsation of the flow and incrustation or clogging of the heating or cooling elements.

2. Heat exchanger according to claim 1, characterized in that the flat tubes are arranged in two successive planes which intersect each other at least approximately at an angle of 90°, viewed in the direction of flow of the heat exchanger.

3. Heat exchanger according to claim 1, characterized in that the flat tubes (1) of one row (2, 3) run at least approximately parallel to the flat tubes (1) of the second-following row (2' 3') of cooling or heating elements.

4. Heat exchanger according to claim 3, characterized in that the flat tubes (1) of one row (2) are staggered in relation to the parallel flat tubes (1) of the second-following row (2') of flat tubes, viewed in the direction of flow (X) of the heat exchanger, preferably by half the lateral center-to-center distance (m) between two adjacent flat tubes (1) of a row of flat tubes.

5. Heat exchanger according to claim 1 characterized in that the straight flow-through area (4) for the highly viscous, free-flowing substance to be cooled or heated is formed by a tube section (5) which runs in the longitudinal direction of the heat exchanger, the tube section has a polygonal cross section having outer surfaces is located inside a cylindrical jacket (6), and is provided with an even number of supply and take-off conduits (11, 12, 13, 14) running in the longitudinal direction of the heat exchanger and separated from each other for supplying and removing the cooling or heating medium to be guided through the individual cooling or heating elements (1), the supply and takeoff conduits are formed between the individual outer surfaces (7, 8, 9, 10) of the tube section (5) and the inside of the cylindrical jacket (6), and heating and cooling medium flowing into the cooling or heating elements (1) flows through the cooling or heating elements into two of the removal conduits (10, 12, 11, 13) which are located opposite one another.

* * * * *